US007894737B2

(12) United States Patent
Shimizu

(10) Patent No.: US 7,894,737 B2
(45) Date of Patent: Feb. 22, 2011

(54) IMAGE-FORMING DEVICE

(75) Inventor: Takashi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/562,901

(22) Filed: Sep. 18, 2009

(65) Prior Publication Data

US 2010/0080581 A1 Apr. 1, 2010

(30) Foreign Application Priority Data

Sep. 29, 2008 (JP) ..... 2008-249855

(51) Int. Cl.
*G03G 21/14* (2006.01)

(52) U.S. Cl. ..... 399/76; 399/36; 399/167; 399/303

(58) Field of Classification Search ..... 399/36, 399/75–78, 107, 167, 303, 306
See application file for complete search history.

(56) References Cited

U.S. PATENT DOCUMENTS

| | | | | |
|---|---|---|---|---|
| 5,583,630 | A * | 12/1996 | Kimura et al. | 399/227 |
| 6,301,458 | B1 | 10/2001 | Mori et al. | |
| 7,016,627 | B2 | 3/2006 | Shibuya et al. | |
| 2005/0271418 | A1 * | 12/2005 | Kojima | 399/167 |

FOREIGN PATENT DOCUMENTS

| | | |
|---|---|---|
| JP | 2000-227717 | 8/2000 |
| JP | 2002-049290 | 2/2002 |
| JP | 2002-182537 | 6/2002 |
| JP | 2004-093987 | 3/2004 |
| JP | 2004-117644 | 4/2004 |
| JP | 2005-173003 | 6/2005 |

OTHER PUBLICATIONS

Office Action received for counterpart Japanese Application 2008-249855, mailed Aug. 31, 2010.

* cited by examiner

*Primary Examiner*—David P Porta
*Assistant Examiner*—Benjamin Schmitt
(74) *Attorney, Agent, or Firm*—Banner & Witcoff, LTD

(57) ABSTRACT

In the image-forming device, the second driving force is transmitted from each input coupling to the corresponding output coupling to rotate the corresponding photosensitive drum when each input coupling is positioned at a predetermined position for the corresponding output coupling. The first detecting unit and the second detecting units detect a position of each input coupling and a position of each output coupling respectively before the first driving unit begins to provide the first driving force and the second driving unit begins to provide the first driving force. The calculating unit calculates, based on the position of each input coupling and the position of each output coupling, a first start timing when a first photosensitive drum starts to rotate and a second start timing when a second photosensitive drum starts to rotate. The controlling unit controls the first driving unit to begin to provide the first driving force after the first start timing and before the second start timing.

10 Claims, 10 Drawing Sheets

IMAGE-FORMING DEVICE

CROSS REFERENCE TO RELATED APPLICATION

This application claims priority from Japanese Patent Application No. 2008-249855 filed Sep. 29, 2008. The entire content of this priority application is incorporated herein by reference.

TECHNICAL FIELD

The present invention relates to an image-forming device, and particularly to a mechanism for driving an endless belt and photosensitive drums in the image-forming device during an image-forming operation.

BACKGROUND

Some conventional image-forming devices employing an electrophotographic system have been equipped with coupling mechanisms rather than gear mechanisms for driving the photosensitive drums and the endless belt disposed in confrontation with the photosensitive drums. In this type of image-forming device, the driving force is provided for the couplings of the photosensitive drums and the coupling of the endless belt simultaneously. However, the time that elapses before the couplings of the photosensitive drums are engaged is often different from the time that elapses before the couplings of the endless belt are engaged, even if the driving force is provided for the couplings of the photosensitive drums and the coupling of the endless belt simultaneously. As the result, the time the photosensitive drums starts to rotate is different from the time the endless belt starts to rotate, which can lead to fluctuations in load applied to the photosensitive drums. The fluctuation of the load can cause problems in image formation and the like. Thus, various image-forming devices have been proposed to resolve such image-forming problems and the like resulting from this time differential.

With the electrophotographic image-forming device disclosed in Japanese unexamined patent application publication No. 2004-117644, for example, the start timing for driving an intermediate transfer belt is set earlier than the start timing for driving the photosensitive drums to avoid the occurrence of image forming problems caused by fluctuations in load applied to the photosensitive drums.

SUMMARY

However, since the image-forming device of Japanese unexamined patent application publication No. 2004-117644 begins driving the intermediate transfer belt before beginning to rotate the photosensitive drums, the intermediate transfer belt slides against the nonmoving photosensitive drums. As a result, the belt can scratch the photosensitive drums along the axial length thereof, leading to problems in printing quality.

Further, when this method of drive coupling is used to drive each photosensitive drum and the endless belt in an electrophotographic color printer, the time required to engage the couplings for each photosensitive drum often varies for each color. Hence, even more time may elapse after the image-forming device begins driving the endless belt and before the photosensitive drum engaged last is driven, potentially leading to more severe scratches in or damage to the photosensitive drum.

In view of the foregoing, it is an object of the present invention to provide an image-forming device capable of minimizing scratches and wear produced both on the photosensitive drums and the endless belt by the endless belt sliding over the nonmoving photosensitive drums, while avoiding the occurrence of image forming problems.

In order to attain the above and other objects, the invention provides an image-forming device including a first driving unit that provides a first driving force, an endless belt that is rotated by the first driving force, a plurality of photosensitive drums opposing the endless belt, a second driving unit that provides a second driving force, a plurality of input couplings that receives the second driving force, a plurality of output couplings corresponding to both the plurality of input couplings and the plurality of photosensitive drums respectively, a first detecting unit that detects a position of each input coupling before the first driving unit begins to provide the first driving force and the second driving unit begins to provide the first driving force, a second detecting unit that detects a position of each output coupling before the first driving unit begins to provide the first driving force and the second driving unit begins to provide the first driving force, a calculating unit, and a controlling unit. The second driving force is transmitted from each input coupling to the corresponding output coupling to rotate the corresponding photosensitive drum when each input coupling is positioned at a predetermined position for the corresponding output coupling. The calculating unit calculates, based on the position of each input coupling and the position of each output coupling, a first start timing when a first photosensitive drum starts to rotate and a second start timing when a second photosensitive drum starts to rotate. The first photosensitive drum is the photosensitive drum that starts to rotate first when the second driving unit provides the second driving force. The second photosensitive drum is the photosensitive drum that starts to rotate last when the second driving unit provides the second driving force. The controlling unit controls the first driving unit to begin to provide the first driving force after the first start timing and before the second start timing.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, preferred embodiments of the present invention in which the image-forming device is a printer will be described while referring to the accompanying drawings.

First Embodiment

Figure 1:
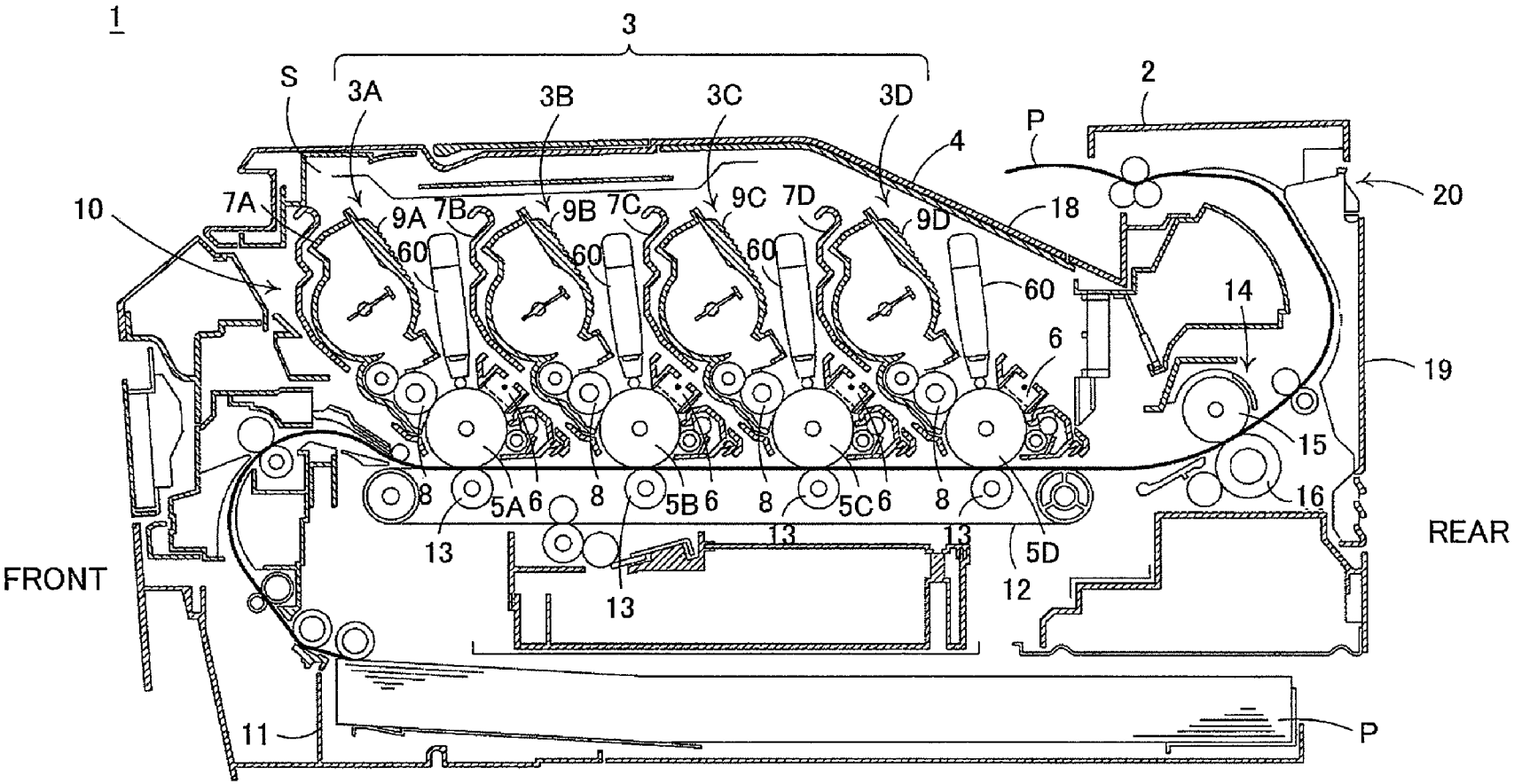
FIG. 1 is a side cross-sectional view of a printer.

FIGS. 1 through 14 illustrate the structure and operations of a printer serving as the first embodiment of the present invention. First, the overall structure of the printer will be described. FIG. 1 is a side cross-sectional view of a printer 1.

The printer 1 is a tandem-type color printer. The body of the printer 1 is configured of a main casing 2 formed in a box shape that is substantially rectangular in a side view. An accommodating space S is formed inside the main casing 2. The accommodating space S functions to accommodate a drum retainer 10.

The drum retainer 10 is configured of four process cartridges 3, and more specifically first through fourth process cartridges 3A-3D respectively provided for each of the colors yellow, magenta, cyan, and black. The process cartridges 3 are arranged parallel to each other and juxtaposed in the front-to-rear direction. A top cover 4 is provided as the top surface of the main casing 2 and can be opened to expose the four process cartridges 3. When the top cover 4 is open, the process cartridges 3 can be mounted in or removed from the main casing 2. An LED unit 60 is also provided for each process cartridge 3 to irradiate LED light onto the respective first through fourth photosensitive drums 5A-5D.

Each of the first through fourth process cartridges 3A-3D has a respective first through fourth drum cartridge 7A-7D (hereinafter also referred to collectively as "drum cartridges 7"), and a respective first through fourth developing cartridge 9A-9D (hereinafter also referred to collectively as "developing cartridges 9") detachably mounted on the respective first through fourth drum cartridge 7A-7D. Each of the drum cartridges 7 retains a respective first through fourth photosensitive drums 5A-5D (hereinafter also referred to collectively as "photosensitive drums 5") and a Scorotron charger 6, while each of the developing cartridges 9 retains a developing roller 8. The drum retainer 10 may also be configured of a single drum unit having four photosensitive drums, and four developer cartridges.

With this construction, the Scorotron chargers 6 apply a uniform charge to the surfaces of the respective first through fourth photosensitive drums 5A-5D, after which LED lights in the LED units 60 selectively irradiate light onto the surfaces of the first through fourth photosensitive drums 5A-5D, forming electrostatic latent images on the surfaces of the first through fourth photosensitive drums 5A-5D based on image data. The developing rollers 8 carry toner to the surfaces of the respective first through fourth photosensitive drums 5A-5D, developing the electrostatic latent images on the photosensitive drums 5 into visible toner images.

A paper cassette 11 is disposed in the bottom section of the main casing 2 for accommodating a paper P. Various rollers are provided for feeding and conveying sheets of the paper P accommodated in the paper cassette 11 one sheet at a time onto a conveying belt 12. The conveying belt 12 is disposed so as to confront the first through fourth photosensitive drums 5A-5D from the bottom. As the conveying belt 12 circulates, the sheets of paper P conveyed on the conveying belt 12 pass sequentially between the conveying belt 12 and the first through fourth photosensitive drums 5A-5D. Transfer roller 13 are disposed inside the conveying belt 12 at positions respectively opposing the photosensitive drums 5 through the conveying belt 12. As a sheet of paper passes sequentially between the conveying belt 12 and the first through fourth photosensitive drums 5A-5D, toner images carried on the surfaces of the photosensitive drums 5 are sequentially transferred onto the sheet of paper P by a transfer bias applied to the transfer rollers 13.

In the following description, the front side of the printer 1 will refer to the upstream side relative to the direction in which the conveying belt 12 conveys the paper P, and the left and right sides of the printer 1 will be based on the perspective of an observer viewing the printer 1 from the front side.

After the toner images on the photosensitive drums 5 are transferred onto a sheet of paper P, the conveying belt 12 conveys the sheet to a fixing unit 14, where the toner images are fixed to the sheet of paper P by a combination of heat and pressure. The fixing unit 14 includes a heating roller 15, and a pressure roller 16 that applies pressure to the bottom of the heating roller 15. The heating roller 15 includes a metal tube surface-coated with a fluororesin, and a halogen lamp (not shown) inserted in the metal tube for generating heat. The pressure roller 16 is configured of a metal roller shaft covered with a rubber material. As a sheet of paper P passes between the heating roller 15 and the pressure roller 16, the heat generated by the heating roller 15 and the pressure generated by the pressure roller 16 fix the toner image to the paper P.

Subsequently, the sheet of paper P is either discharged onto a discharge tray 18 formed on the top surface of the top cover 4 or is discharged onto a rear cover/tray 19 attached to the rear surface of the main casing 2. The rear cover/tray 19 is attached so as to be able to rotate between an open state sloping outward from the rear side of the main casing 2 to expose an opening 20 in the rear surface of the main casing 2, and a closed state extending along the rear surface of the main casing 2 so as to cover the opening 20. When the rear cover/tray 19 is in the closed state, the inner surface of the rear cover/tray 19 forms part of the discharge path that guides the paper P toward the discharge tray 18. Hence, when the rear cover/tray 19 is in the closed state, a sheet of paper P conveyed from the fixing unit 14 is discharged onto the discharge tray 18. On the other hand, when the rear cover/tray 19 is in the open state, a sheet of paper P conveyed from the fixing unit 14 is discharged onto the rear cover/tray 19 through the opening 20.

Figure 2:
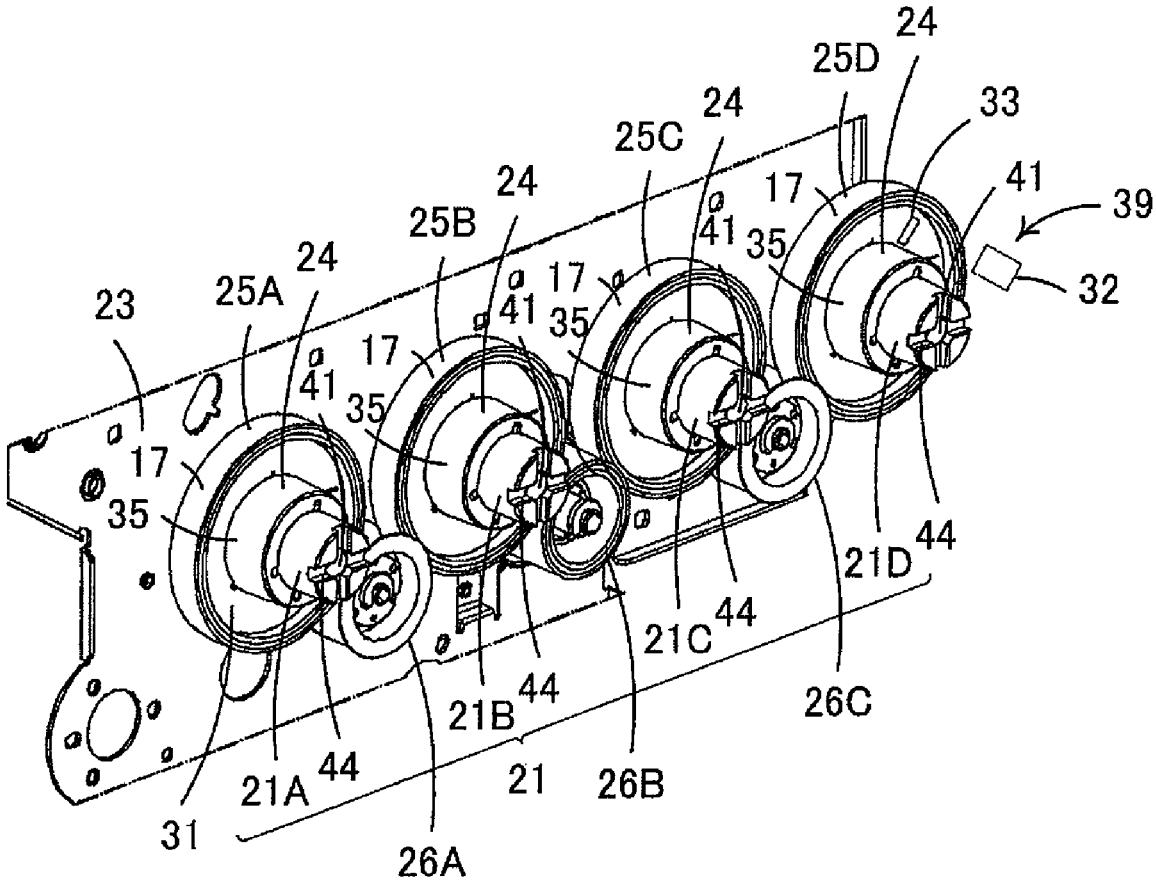
FIG. 2 is a perspective view illustrating a periphery of an input coupling.
Figure 3:
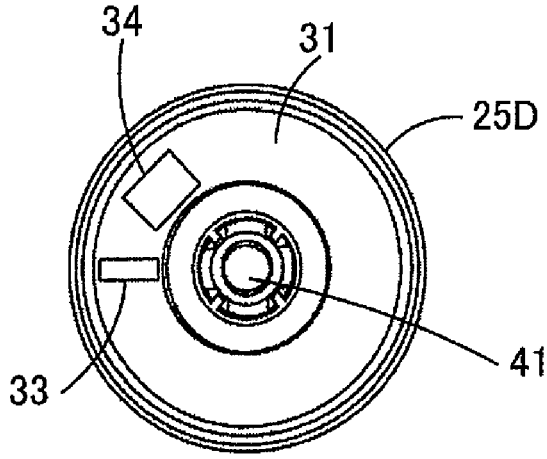
FIG. 3 is a side view from a main casing side of a light-receiving sensor and a fourth drive transmission unit mounted on a frame side.

Next, a drive mechanism for the conveying belt will be described. FIG. 2 is a perspective view illustrating the periphery of an input coupling 21 described later. FIG. 3 is a side view from the main casing 2 side of a light-receiving sensor 34 and a fourth drive transmission unit 25D mounted on a frame side 23 described later.

The main casing 2 is provided with two frame sides 23 (only the left frame side 23 is shown in FIG. 2) parallel to each other and oppose each other in the axial direction of the photosensitive drums 5. Four support shafts 41 are fixed to the frame side 23 and extend rightward (in an example of FIG. 2). First through fourth drive transmission units 25A-25D (hereinafter also referred to collectively as "drive transmission units 25") corresponding to the respective first through fourth process cartridges 3A-3D are provided on the inner surfaces of the frame sides 23 at positions corresponding to the four support shafts 41.

Each of the drive transmission units 25 is integrally provided with a gear unit 17, a protruding part 24 that protrudes rightward from the center region of the gear unit 17, and a connecting part 31 connecting the protruding part 24 to the gear unit 17. Each protruding part 24 has a cylindrical part 35, and an input coupling 21 (first through fourth input couplings 21A-21D) extending right ward from the cylindrical part 35 for engaging with output couplings 22 (first through fourth output couplings 22A-22D) described later. Each of the cylindrical parts 35 and the respective first through fourth input couplings 21A-21D share a common center axis with the respective gear unit 17. The support shafts 41 are inserted into the corresponding cylindrical parts 35 so that the drive transmission units 25 are rotatably supported on the support shafts 41 and can be advanced and retracted relative to the frame side 23 in the left-to-right direction.

First through third drive gear units 26A-26C are disposed one between each pair of adjacent drive transmission units 25 and are intermeshed with the pairs of adjacent gear units 17. When a drum drive motor 42 (see FIG. 10) drives the drive gear unit 26B to rotate, the rotations of the drive gear unit 26B are transmitted to all of the first through fourth drive transmission units 25A-25D via the first through third drive gear units 26A-26C so that the first through fourth drive transmission units 25A-25D rotate in synchronization with the drive gear unit 26B.

Further, one end of a coil spring (not shown) is fixed to each the first through fourth drive transmission units 25A-25D and the other end fixed to the frame side 23. The coil springs constantly urge the drive transmission units 25 rightward.

Grooves 44 are formed in the surfaces of the first through fourth input couplings 21A-21D opposing the respective first through fourth output couplings 22A-22D described later for fitting over input-side protruding parts 55 of the first through fourth output couplings 22A-22D. The grooves 44 are formed in a cross shape with their intersections aligned with the rotational centers of the respective first through fourth input couplings 21A-21D.

The printer 1 is also provided with an input-side position sensor 39 for detecting the rotational position of the grooves 44. Specifically, the input-side position sensor 39 detects the rotational position of the fourth input coupling 21D provided in the fourth drive transmission unit 25D. A through-hole 33 is formed in the connecting part 31. The input-side position sensor 39 includes a light-emitting element 32 positioned opposite the through-hole 33 for emitting light leftward, and a light-receiving sensor 34 (see FIG. 3) opposing the light-emitting element 32 on the opposite side of the connecting part 32 for detecting light from the light-emitting element 32 that passes through the through-hole 33. The light-emitting element 32 and the light-receiving sensor 34 are attached to the frame sides 23.

A control unit 28 described later stores the time that elapses after the light-receiving sensor 34 detects light from the light-emitting element 32 passing through the through-hole 33 until the next time the light-receiving sensor 34 detects light, that is, the time required for the input couplings 21 to complete one rotation. When the input couplings 21 are halted, the control unit 28 can calculate the rotational positions of the grooves 44 at the time driving was halted, by comparing the time that elapsed after the light-receiving sensor 34 previously detected light until the input couplings 21 were halted with the time required for the input couplings 21 to complete one rotation.

In the preferred embodiment, an input-side position sensor is provided for detecting only the rotational position of the input coupling 21D provided on the fourth drive transmission unit 25D, but input-side position sensors may be provided for detecting the rotational positions of all drive transmission units 25.

Figure 4:
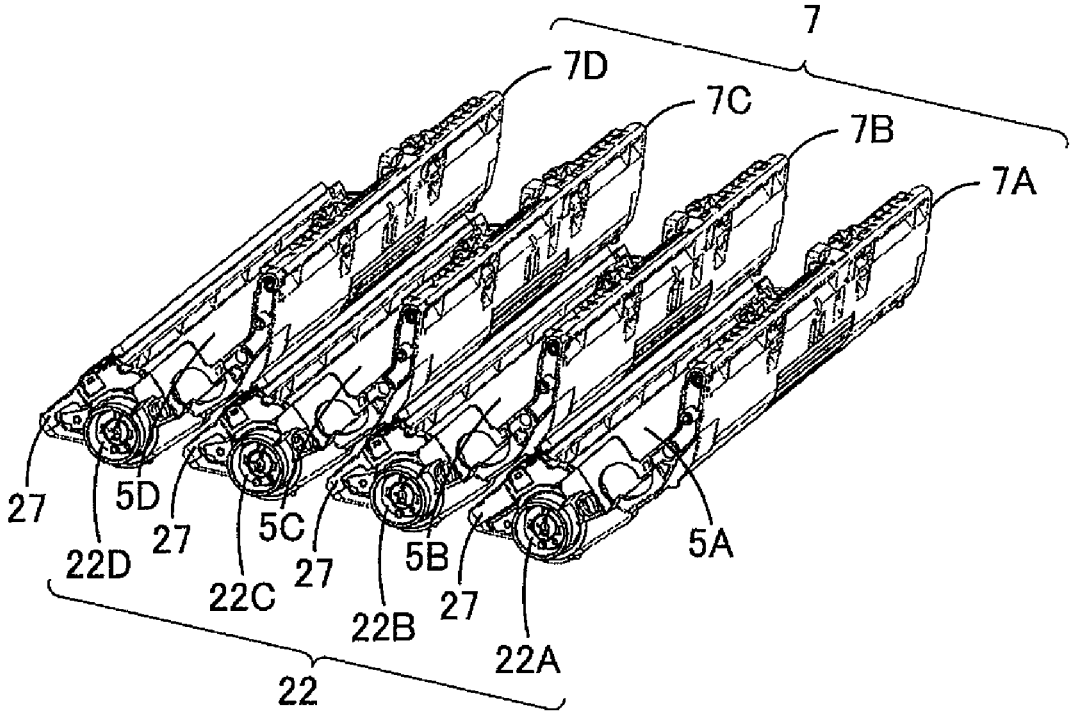
FIG. 4 is a perspective view of a drum cartridges.
Figure 5:
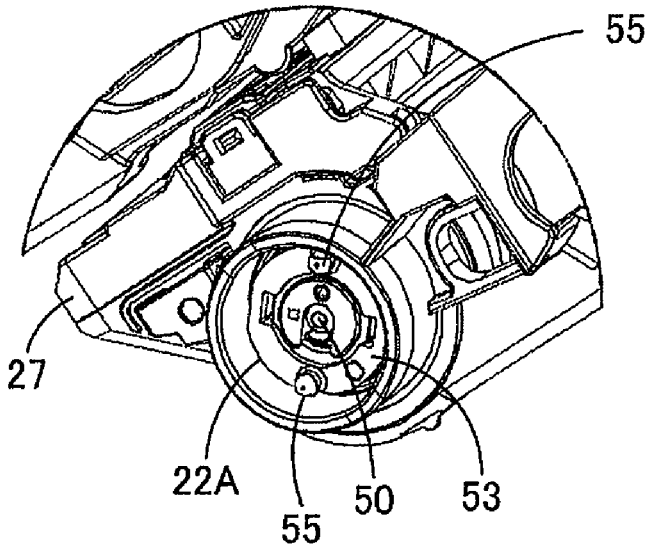
FIG. 5 is an enlarged view of an output coupling.
Figure 6:
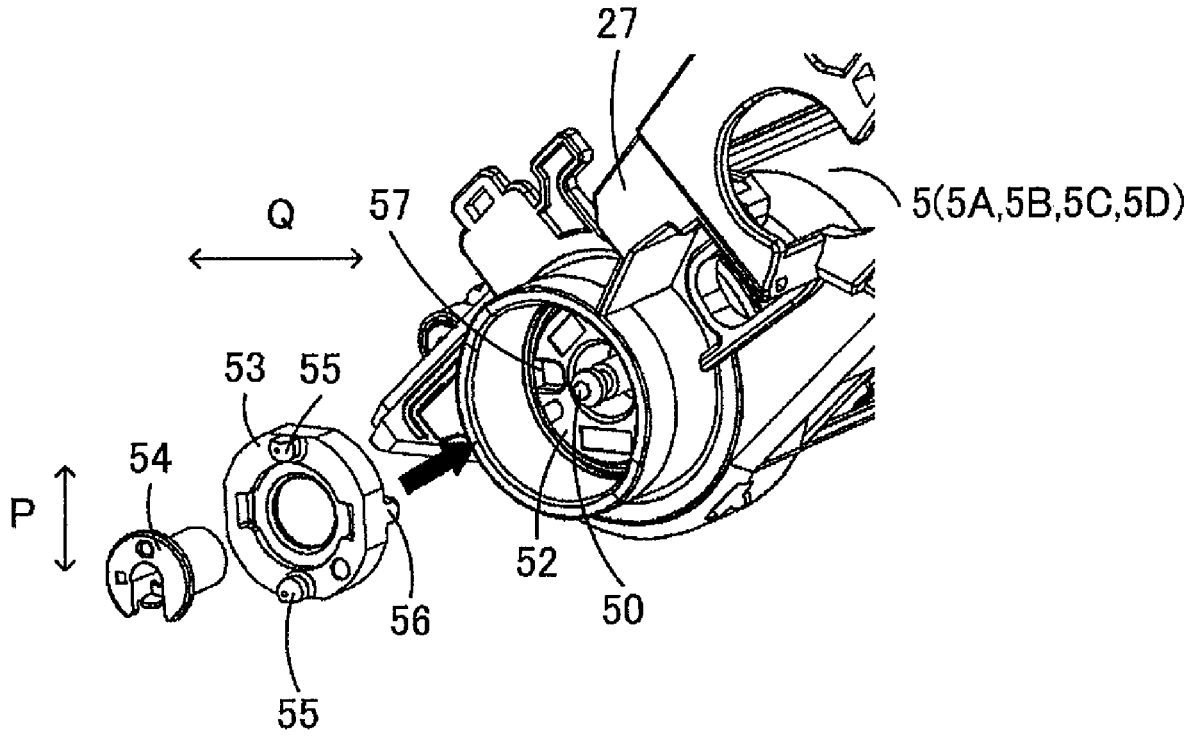
FIG. 6 is a perspective view of a coupling part provided in the output coupling.
Figure 7:
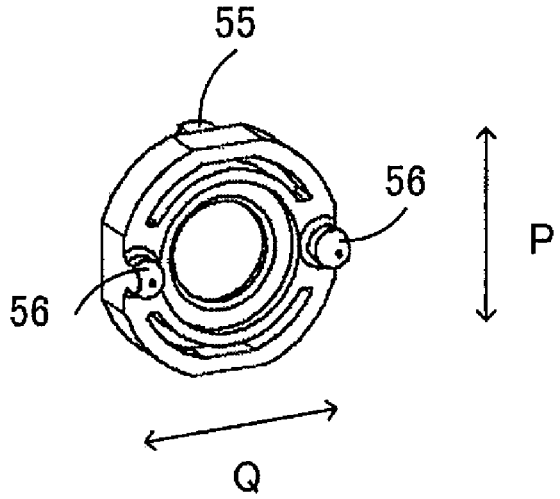
FIG. 7 is a perspective view of the coupling part from a photosensitive drum side.
Figure 8:
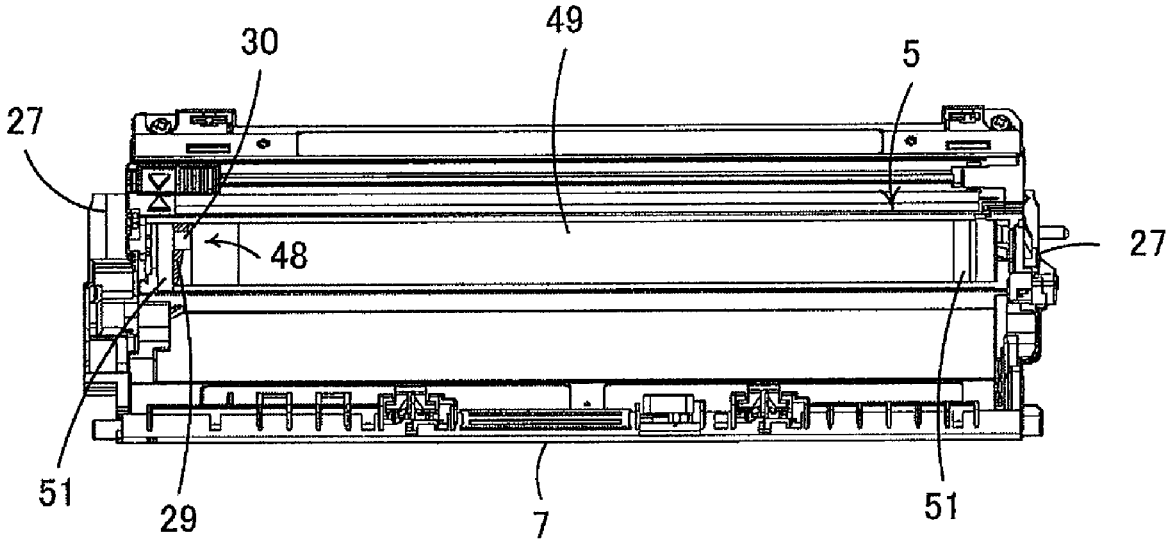
FIG. 8 is a plan view of a drum cartridge and a sensor.
Figure 9:
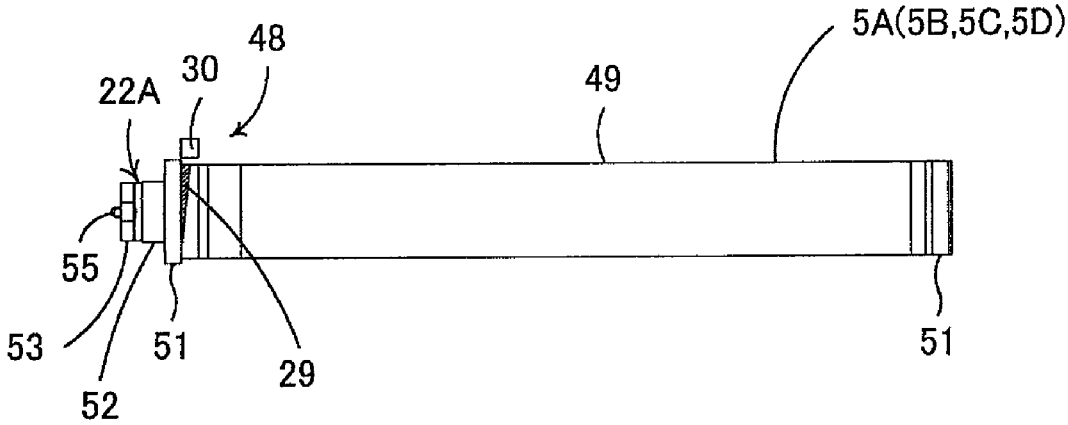
FIG. 9 is a plan view of the sensor and a photosensitive drum.

The drum cartridges 7 will be described next. FIG. 4 is a perspective view of the drum cartridges 7. FIG. 5 is an enlarged view of an output coupling 22 in FIG. 4. FIG. 6 is a perspective view of a coupling part 53 provided in the output coupling 22. FIG. 7 is a perspective view of the coupling part 53 from the photosensitive drum side. FIG. 8 is a plan view of a drum cartridge 7 and a sensor 30. FIG. 9 is a plan view of the sensor 30 and one of the photosensitive drums 5.

Each of the first through fourth drum cartridge 7A-7D has a pair of side plates 27 for rotatably supporting the respective first through fourth photosensitive drums 5A-5D. As shown in FIGS. 5 and 9, each photosensitive drum 5 includes a drum body 49, a drum shaft 50, and support parts 51 provided on both ends of the drum body 49 and supported in the side plates 27. The first through fourth output couplings 22A-22D are each provided on one end of the respective first through fourth photosensitive drums 5A-5D for engaging with the respective first through fourth input couplings 21A-21D when the first through fourth process cartridges 3A-3D are mounted in the main casing 2.

As shown in FIGS. 6 and 9, each of the output couplings 22 includes a coupling body 52 protruding outward from the support parts 51, a coupling part 53 fixed to the coupling body 52 for transmitting rotations of the respective input coupling 21 to the respective photosensitive drum 5, and a stopper part 54 for fixing the coupling part 53 to the coupling body 52.

Two input-side protruding parts 55 are formed on the side surface of the coupling part 53 opposing the input coupling 21 at positions 180 degrees from each other about the rotational center of the photosensitive drum 5. As shown in FIG. 7, two output-side protruding parts 56 are formed on the side surface of the coupling part 53 opposing the coupling body 52 at positions 180 degrees from each other about the rotational center of the photosensitive drum 5. If a line connecting the input-side protruding parts 55 follows a direction P and a line connecting the output-side protruding parts 56 follows a direction Q, the direction Q is offset 90 degrees from the direction P.

Two recessed parts 57 are formed in the side surface of the coupling body 52 so as to be symmetric about the rotational center of the photosensitive drum 5 (only one recessed part 57 is shown in FIG. 6). When the coupling part 53 is fixed to the coupling body 52 by the stopper part 54, the output-side protruding parts 56 formed on the coupling part 53 are engaged in the recessed parts 57.

When the input couplings 21 are fitted into the respective output couplings 22, the input-side protruding parts 55 formed on the coupling parts 53 are engaged in the grooves 44 formed in the input couplings 21. Accordingly, the input-side protruding parts 55 formed on the coupling part 53 of each output coupling 22 can engage with the grooves 44 of the respective input coupling 21 at rotational intervals of 90 degrees.

Further, by arranging the output-side protruding parts 56 and input-side protruding parts 55 so that the direction Q of the line connecting the output-side protruding parts 56 is offset 90 degrees from the direction P of the line connecting the input-side protruding parts 55, the coupling part 53 has more freedom of movement in the Q direction relative to the coupling body 52 and in the P direction relative to the input coupling 21. Therefore, the rotations of the first through fourth input couplings 21A-21D can be reliably transmitted to the first through fourth photosensitive drums 5A-5D, even when the rotational axes of the first through fourth photosensitive drums 5A-5D and respective first through fourth input couplings 21A-21D are offset.

The coupling part 53 may also be provided on the input coupling 21 side. In this case, recessed parts would be provided in the first through fourth input couplings 21A-21D for engaging with the input-side protruding parts 55 formed on the coupling part 53, and a cross-shaped groove part would be formed in the surface of the coupling body 52 opposing the first through fourth input couplings 21A-21D. In this way, the rotations of the first through fourth input couplings 21A-21D can be transmitted to the first through fourth output couplings 22A-22D, causing the first through fourth photosensitive drums 5A-5D to rotate together with the respective first through fourth output couplings 22A-22D.

The printer 1 also includes output-side position sensors 48 for detecting the rotational position of the input-side protruding parts 55. As shown in FIG. 9, each output-side position sensor 48 includes a marker part 29 formed peripherally around one end of the respective photosensitive drum 5, the marker part 29 having a varying width (i.e., dimension in the axial direction of the photosensitive drum 5); and a sensor 30 for detecting the rotational position of the respective photosensitive drum 5 based on the width of the marker part 29. The marker part 29 is formed on the support part 51, which is formed from the same resin as the photosensitive drums 5, by treating the surface of the support parts 51 with a coating having a different reflectance from the resin.

The sensor 30 is provided on each of the LED units 60 (FIG. 1) and is disposed in a state of non-contact with the respective photosensitive drum 5. The sensor 30 irradiates light onto the region of the corresponding marker part 29 to detect the width of the marker part 29 based on the difference in reflectance.

When the top cover 4 is opened on the top surface of the main casing 2, the drive transmission units 25A-25D move leftward in association with the opening of the top cover 4 through a construction well known in the art. This movement disengages the input couplings 21A-21D from the output couplings 22A-22D. Once the operator has finished removing and replacing the drum cartridges 7 or developing cartridges 9 and closes the top cover 4, the drive transmission units 25A-25D move rightward in association with the closing of the top cover 4, thereby reengaging the input couplings 21A-21D with the output couplings 22A-22D. Hence, the input and output couplings are disengaged and engaged through the opening and closing operations of the top cover 4.

Further, after the top cover 4 is opened and closed, the printer 1 initiates a warm-up operation in which the conveying belt 12 and the first through fourth photosensitive drums 5A-5D are driven in order to clean the same.

Next, the electrical configuration for printer drive control will be described.

Figure 10:
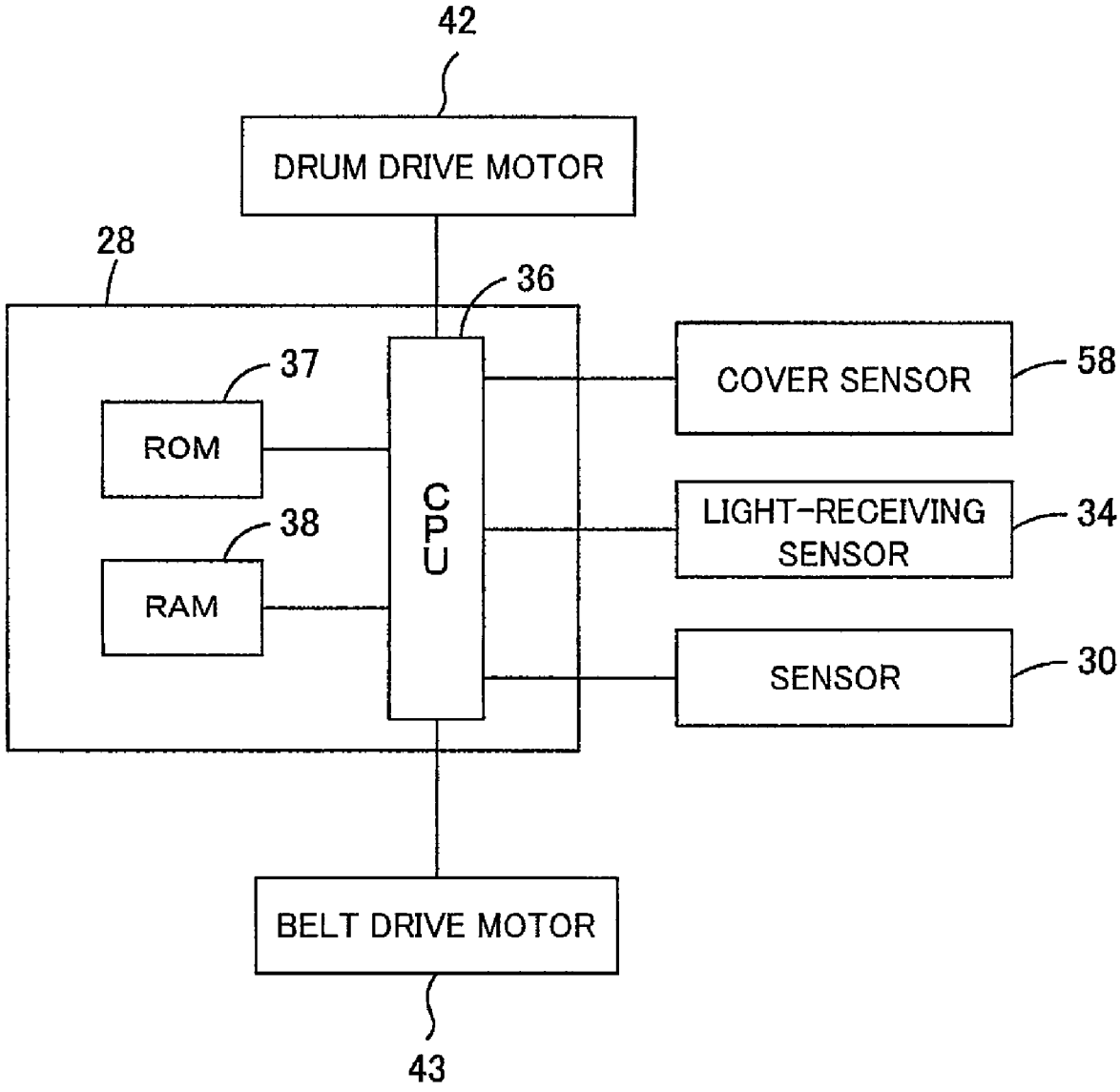
FIG. 10 is a block diagram of electrical configuration for drive control.

As shown in FIG. 10, the electrical configuration for drive control includes a control unit 28 for controlling the start time for driving the conveying belt 12 based on positional detection data, a cover sensor 58 for detecting opening and closing of the top cover 4, the drum drive motor 42 for driving each of the first through fourth drive transmission units 25A-25D, a belt drive motor 43 for driving the conveying belt 12, the light-receiving sensor 34 of the input-side position sensor 39, and the sensors 30 of the output-side position sensors 48. The control unit 28 is a microcomputer well known in the art that includes a CPU 36, a ROM 37, and a RAM 38, as shown in FIG. 10.

Figure 11:
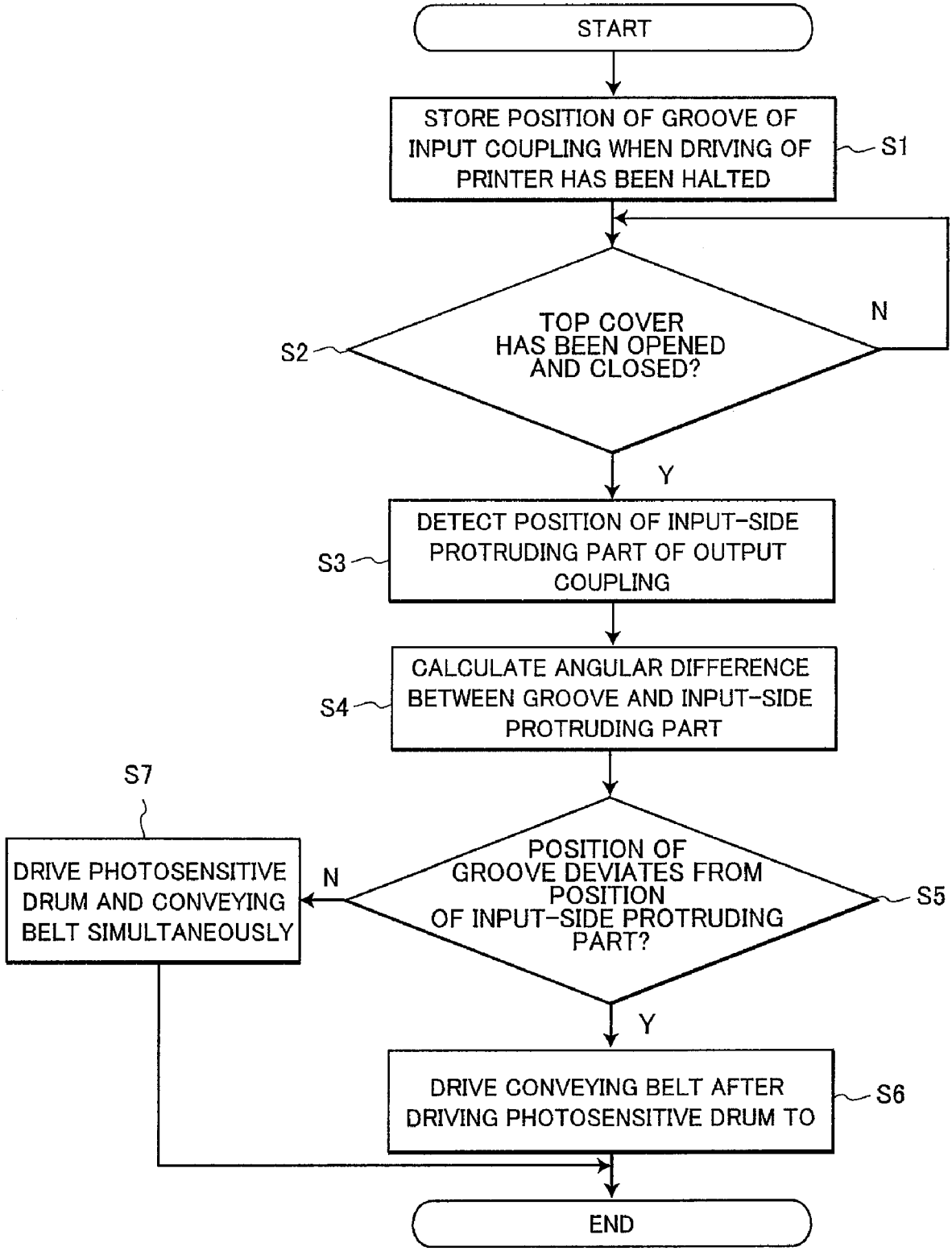
FIG. 11 is a flowchart illustrating steps in a process performed by a CPU.
Figure 12:
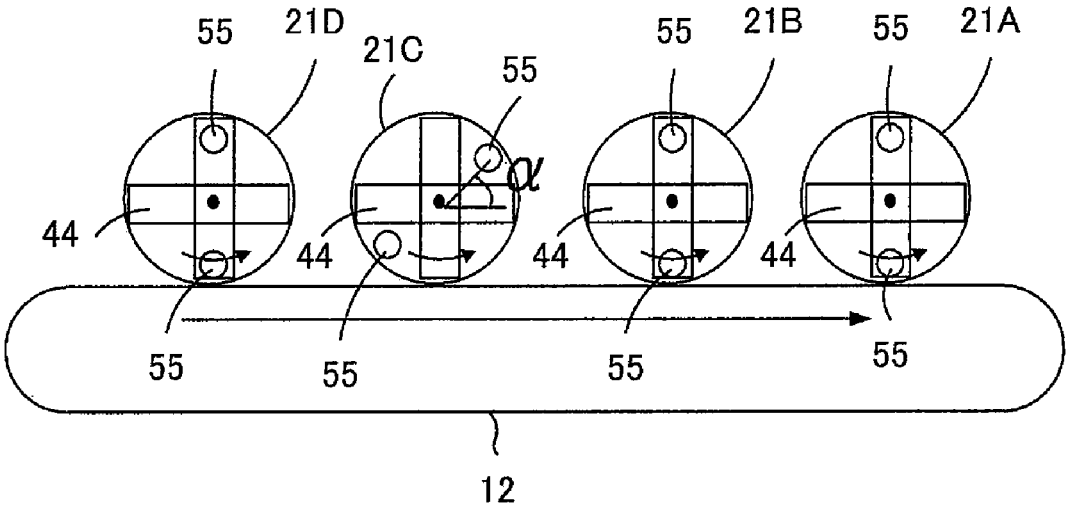
FIG. 12 is an explanation diagram of an angular difference between an input coupling and an output coupling.

FIG. 11 is a flowchart illustrating steps in a process performed by the CPU 36 of the control unit 28 based on a program stored in the ROM 37. The following description will cover a case in which a user opens the top cover 4 and replaces the third drum cartridge 7C for the color magenta, at which time the positions of the input-side protruding parts 55 formed on the third output coupling 22C have shifted from the position of the grooves 44 formed in the third input coupling 21C, as shown in FIG. 12. Although the first through fourth drive transmission units 25A-25D are constantly urged to the right by coil springs, as described above, in this case the input-side protruding parts 55 on the third output coupling 22C contact the endface of the third input coupling 21C and press the drive transmission unit 25C leftward.

In the following description, "Step 1" and the like will be abbreviated as "S1," for example. In S1 of FIG. 11, the control unit 28 stores positional data for the grooves 44 of the input coupling 21D detected by the input-side position sensor 39 according to the method described above when driving of the printer 1 is halted. In S2 the control unit 28 continues to wait while the top cover 4 has not been opened and closed (S2: NO). When the top cover 4 has been opened and closed and the printer 1 begins the warm-up operation (S2: YES), in S3 the control unit 28 actuates the sensors 30 to detect the positions of the first through fourth output couplings 22A-22D. After the sensors 30 detect the positions of the input-side protruding parts 55, the control unit 28 receives positional data for the input-side protruding parts 55 from these sensors 30. In S4 the control unit 28 calculates an angular difference $\alpha$ between each groove 44 and the corresponding input-side protruding parts 55 based on the positional data for the input-side protruding parts 55 of each output coupling 22 detected in S3 and positional data for the groove 44 of the corresponding input coupling 21 stored by the control unit 28 in S1.

In S5 the control unit 28 determines based on the angular difference $\alpha$ calculated in S4 whether the position of the groove 44 for each input coupling 21 deviates from the position of the input-side protruding parts 55 for the corresponding output coupling 22. If the control unit 28 detects positional deviation (S5: YES), in S6 the control unit 28 calculates the time required for each of the first through fourth photosensitive drums 5A-5D (first through fourth output couplings 22A-22D) to be driven based on the rotational speed of the input couplings 21 and the respective angular differences a calculated in S4. The control unit 28 then begins driving the conveying belt 12 at a point between the drive start timing for the photosensitive drum that is driven first and the drive start timing for the photosensitive drum that is driven last.

Figure 13:
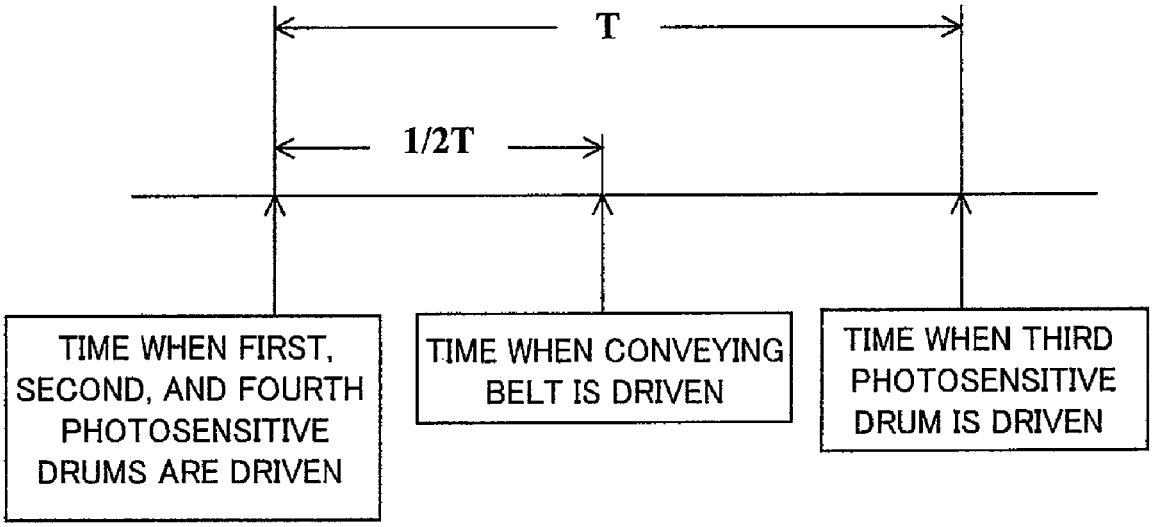
FIG. 13 is an explanation diagram of a time when a conveying belt begins to be driven.

As illustrated in FIG. 13, in this example the control unit 28 calculates a time T until the third photosensitive drum 5C (third input coupling 21C) will be driven based on the rotational speed of the third input coupling 21C and the corresponding angular difference $\alpha$. After calculating this time T, the control unit 28 begins the warm-up operation in which the drum drive motor 42 drives the first through fourth input couplings 21A-21D via the drive gear unit 26B. However, since only the first, second, and fourth output couplings 22A, 22B, and 22D are engaged with the corresponding input couplings 21 at this time, only the first, second, and fourth photosensitive drums 5A, 5B, and 5D are initially driven to rotate.

Hence, the control unit 28 initially begins driving the first, second, and fourth output couplings 22A, 22B, and 22D until one half the time T (½ T) has elapsed before actuating the belt drive motor 43 to begin driving the conveying belt 12. Subsequently, after ½ T has again elapsed, the input-side protruding parts 55 of the third input coupling 21C are fitted into the groove 44 of the third input coupling 21C and, thus, the third photosensitive drum 5C coupled to the third output coupling 22C is driven to rotate. The control unit 28 ends the process shown in FIG. 11 after the first through fourth photosensitive drums 5A-5D and the conveying belt 12 are being driven, as described above.

On the other hand, if no positional deviations are detected in S5 (S5: NO), in S7 the control unit 28 actuates the drum drive motor 42 and the belt drive motor 43 simultaneously so that the first through fourth photosensitive drums 5A-5D and the conveying belt 12 are operated simultaneously in the warm-up operation.

The effects of the first embodiment will be described next. With the above configuration of the preferred embodiment, the control unit 28 can minimize the overall damage incurred by the photosensitive drums 5 from the conveying belt 12 and the damage incurred by the conveying belt 12 from the photosensitive drums 5 and can thus prevent problems in printing quality by driving the conveying belt 12 at a time after beginning to drive the initially-driven photosensitive drum and before beginning to drive the ultimately-driven photosensitive drum.

Further, the rotations of the first through fourth input couplings 21A-21D can be reliably transmitted to the respective first through fourth output couplings 22A-22D by fitting the input-side protruding parts 55 formed on the first through fourth output couplings 22A-22D in the groove 44 of the respective first through fourth input couplings 21A-21D.

Further, since the grooves 44 formed on the first through fourth input couplings 21A-21D are cross-shaped, the input-side protruding parts 55 on the first through fourth output couplings 22A-22D can engage in the grooves 44 at 90-degree intervals in the rotating direction. Accordingly, even if one of the pairs of input couplings 21 and output couplings 22 becomes disengaged, the pair re-engages very quickly, thereby minimizing the amount of damage incurred by the first through fourth photosensitive drums 5A-5D and the conveying belt 12.

Figure 14:
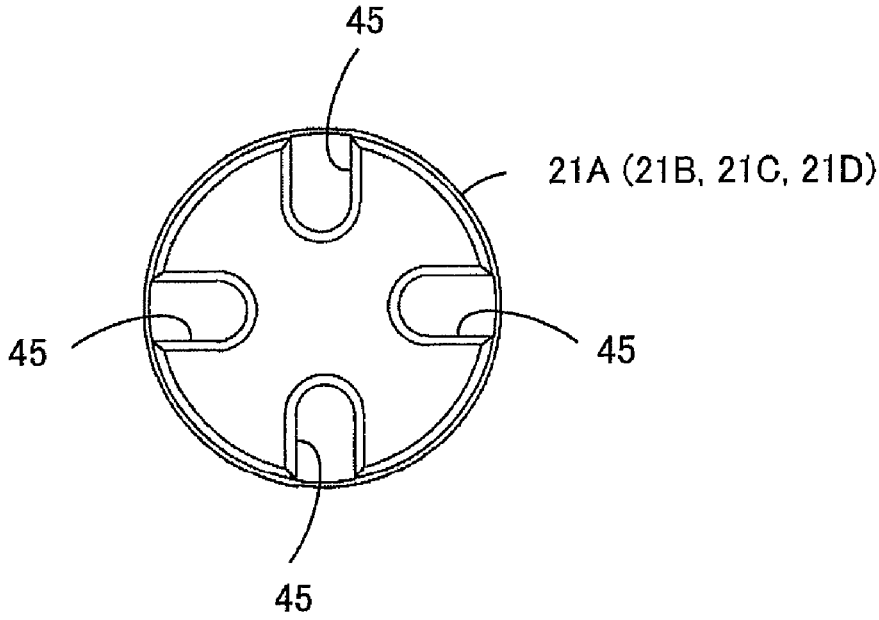
FIG. 14 illustrates a variation of the input coupling according to the first embodiment.

FIG. 14 illustrates a variation of the input coupling 21 according to the first embodiment. According to this variation, four recessed parts 45 are formed in the surface of each of the first through fourth input couplings 21A-21D opposing the corresponding first through fourth output couplings 22A-22D. The recessed parts 45 are formed in the peripheral edges of the input coupling 21 at 90-degree intervals about the rotational center of the same and engage with the input-side protruding parts 55 formed on the respective output coupling 22.

Second Embodiment

Figure 15:
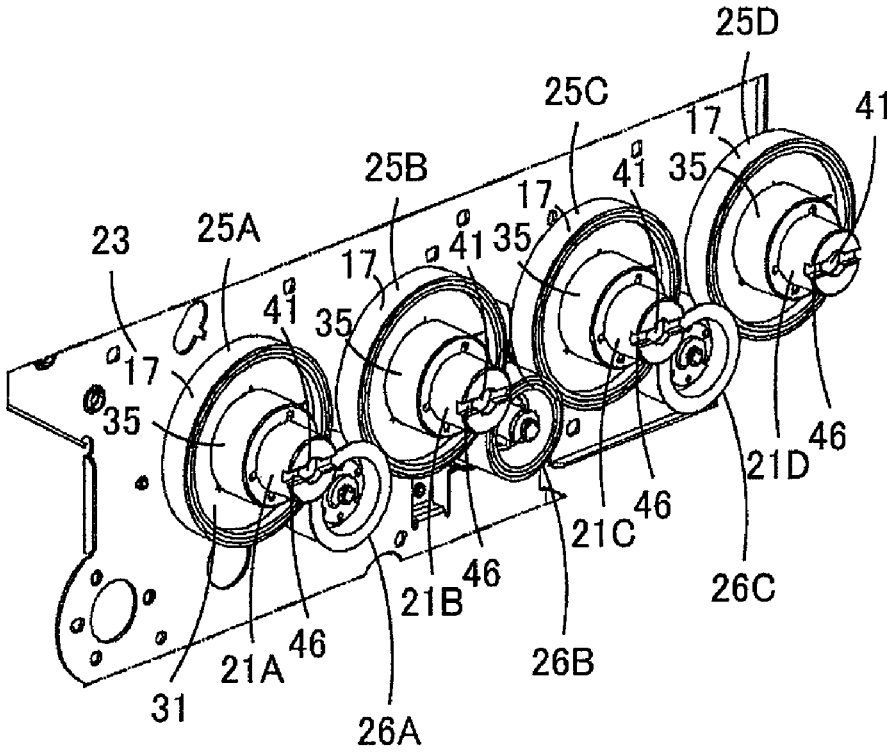
FIG. 15 is a perspective view illustrating first through fourth input couplings according to a second embodiment.

Next, a second embodiment of the present invention will be described with reference to FIG. 15. FIG. 15 is a perspective view illustrating the first through fourth input couplings 21A-21D. In a printer according to the second embodiment, a groove 46 is formed in the surface of each input coupling 21 opposing the respective output coupling 22. The groove 46 is formed in a linear shape that passes through the rotational center of the corresponding input coupling 21 so that the output couplings 22 and corresponding input couplings 21 engage at rotational intervals of 180 degrees. Since the remaining construction is identical to that described in the first embodiment, like parts and components are designated with the same reference numerals to avoid duplicating description. Note that the input-side position sensor 39 is omitted from the drawing of FIG. 15.

Figure 16:
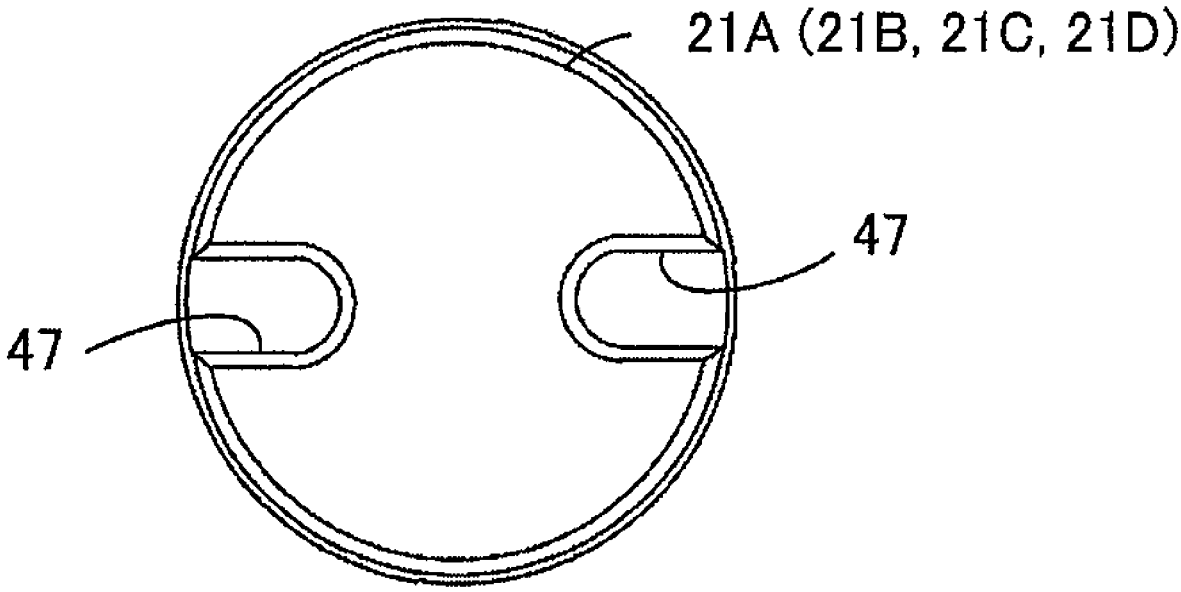
FIG. 16 shows a variation of the input coupling according to the second embodiment.

FIG. 16 shows a variation of the input coupling 21 according to the second embodiment. According to this variation, two recessed parts 47 are formed in the surface of each first through fourth input couplings 21A-21D opposing the corresponding first through fourth output couplings 22A-22D. The recessed parts 47 are symmetric about the rotational center of the input coupling 21 and are shaped to engage with the input-side protruding parts 55 formed on the corresponding output coupling 22.

With the construction according to the second embodiment and its variation, the molding precision of the grooves 46 or recessed parts 47 and the input-side protruding parts 55 has less influence on the timing at which each pair of input couplings 21 and output couplings 22 becomes engaged since the input couplings 21 and output couplings 22 can engage once every rotation of 180 degrees. Consequently, this construction can suppress problems in color registration since there is less chance for rotational irregularities among the first through fourth photosensitive drums 5A-5D.

While the invention has been described in detail with reference to the embodiments thereof, it would be apparent to those skilled in the art that various changes and modifications may be made therein without departing from the spirit of the invention.

For example, although the control unit 28 actuates the belt drive motor 43 to begin driving the conveying belt 12 after one half the time T (½ T) has elapsed, the belt drive motor 43 can be actuated within the time T. However, actuating after one half the time T (½ T) has elapsed can minimize the overall damage.

Further, in the first embodiments, the control process is started when the top cover 4 is opened and closed. However, a similar control process may be performed when the power of the printer 1 is turned on.

What is claimed is:

1. An image-forming device comprising:

a first driving unit that provides a first driving force;

an endless belt that is rotated by the first driving force;

a plurality of photosensitive drums opposing the endless belt;

a second driving unit that provides a second driving force;

a plurality of input couplings that receives the second driving force;

a plurality of output couplings corresponding to both the plurality of input couplings and the plurality of photosensitive drums respectively, the second driving force being transmitted from each input coupling to the corresponding output coupling to rotate the corresponding photosensitive drum when each input coupling is positioned at a predetermined position for the corresponding output coupling;

a first detecting unit that detects a position of each input coupling before the first driving unit begins to provide the first driving force and the second driving unit begins to provide the first driving force;

a second detecting unit that detects a position of each output coupling before the first driving unit begins to provide the first driving force and the second driving unit begins to provide the first driving force;

a calculating unit that calculates, based on the position of each input coupling and the position of each output coupling, a first start timing when a first photosensitive drum starts to rotate and a second start timing when a second photosensitive drum starts to rotate, the first photosensitive drum being the photosensitive drum that starts to rotate first when the second driving unit provides the second driving force, the second photosensitive drum being the photosensitive drum that starts to rotate last when the second driving unit provides the second driving force; and a controlling unit that controls the first driving unit to begin to provide the first driving force after the first start timing and before the second start timing.

2. The image-forming device according to claim 1, wherein each input coupling has an engaged portion, and rotates about an input rotational axis to transmit the second driving force to the corresponding output coupling;

wherein each output coupling has an engaging portion, and rotates about an output rotational axis to transmit the second driving force to the corresponding photosensitive drum, the second driving force being transmitted from each input coupling to the corresponding output coupling to rotate the corresponding photosensitive drum when the corresponding engaged portion is engaged with the corresponding engaging portion, wherein the first detecting unit detects a rotational position of each engaged portion, and the second detecting unit detects a rotational position of each engaging portion, and wherein the calculating unit calculates the first start timing and the second timing based on the position of each engaged portion and the position of each engaging portion.

3. The image-forming device according to claim 2, wherein one of each engaged portion and the corresponding engaging portion has a pair of protrusions that are symmetric with respect to the input rotational axis, and wherein remaining one of each engaged portion and the corresponding engaging portion has a groove having a cross shape whose intersection is aligned with the output rotational axis.

4. The image-forming device according to claim 2, wherein one of each engaged portion and the corresponding engaging portion has a pair of protrusions that are symmetric with respect to the input rotational axis, and wherein remaining one of each engaged portion and the corresponding engaging portion has four grooves arranged at rotational intervals of 90 degrees from each other with respect to the output rotational axis.

5. The image-forming device according to claim 2, wherein one of each engaged portion and the corresponding engaging portion has a pair of protrusions that are symmetric with respect to the input rotational axis, and wherein remaining one of each engaged portion and the corresponding engaging portion has a groove having a linear shape crossing the output rotational axis.

6. The image-forming device according to claim 2, wherein one of each engaged portion and the corresponding engaging portion has a pair of protrusions that are symmetric with respect to the input rotational axis, and wherein remaining one of each engaged portion and the corresponding engaging portion has a pair of grooves that are symmetric with respect to the output rotational axis.

7. The image-forming device according to claim 1, wherein the controlling unit controls the first driving unit to begin to provide the first driving force at a center timing of the first start timing and the second start timing.

8. The image-forming device according to claim 1, wherein each photosensitive drum has a rotational axis extending in an axis direction to rotate in a rotational direction, and a peripheral surface having an end in the axis direction, the end being formed with a marker part having a width in the axial direction that varies in a rotational direction, and wherein the second detecting unit detects the position of each output coupling based on the width.

9. The image-forming device according to claim 1, further comprising:

a gear unit disposed around the input coupling to receive the second driving force; and a connecting unit connecting the gear unit with the input coupling to transmit the second driving force received by the gear unit to the input coupling, wherein the first detecting unit comprises:

a light-emitting unit that emits a light;

a through-hole formed on the connecting unit; and a light-receiving unit disposed at an opposite side of the connecting unit for the light-emitting unit to detect the light that passes thorough the through-hole.

10. The image-forming device according to claim 1, further comprising:

a drum retainer that retains the plurality of photosensitive drums, the plurality of output couplings being provided on the drum retainer;

a casing on which the drum retainer is mountable, the plurality of input couplings being provided on the casing, each input coupling being positionable at the predetermined position for the corresponding output coupling when the drum retainer is mounted on the casing; and a cover openably provided on the casing, the drum retainer being detachable from the casing when the cover is opened, wherein the controlling unit controls the first driving unit to begin to provide the first driving force when the cover is opened and then closed.

* * * * *